US009716318B2

(12) United States Patent
Shirley et al.

(10) Patent No.: US 9,716,318 B2
(45) Date of Patent: Jul. 25, 2017

(54) PATCH ANTENNA ASSEMBLIES

(71) Applicant: Laird Technologies, Inc., Earth City, MO (US)

(72) Inventors: Thomas A. Shirley, Chesaning, MI (US); David A. Swartwood, Swartz Creek, MI (US); Gary Keith Reed, Grand Blanc, MI (US)

(73) Assignee: Laird Technologies, Inc., Earth City, MO (US)

( * ) Notice: Subject to any disclaimer, the term of this patent is extended or adjusted under 35 U.S.C. 154(b) by 248 days.

(21) Appl. No.: 14/546,841

(22) Filed: Nov. 18, 2014

(65) Prior Publication Data

US 2016/0118719 A1 Apr. 28, 2016

Related U.S. Application Data

(60) Provisional application No. 62/067,313, filed on Oct. 22, 2014.

(51) Int. Cl.

| | |
|---|---|
| ***H01Q 1/38*** | (2006.01) |
| ***H01Q 9/04*** | (2006.01) |
| ***H01Q 23/00*** | (2006.01) |

(52) U.S. Cl.

CPC ..... *H01Q 9/0407* (2013.01); *H01Q 9/045* (2013.01); *H01Q 23/00* (2013.01)

(58) Field of Classification Search

CPC ..... H01Q 1/38; H01Q 9/0407; H01Q 9/0421; H01Q 3/26

USPC ..... 343/700 MS, 893, 879, 751

See application file for complete search history.

(56) References Cited

U.S. PATENT DOCUMENTS

| | | | |
|---|---|---|---|
| 5,400,039 | A | 3/1995 | Araki et al. |
| 5,523,761 | A | 6/1996 | Gildea |
| 5,628,053 | A | 5/1997 | Araki et al. |
| 5,668,563 | A | 9/1997 | Ogino et al. |
| 5,682,143 | A | 10/1997 | Brady et al. |
| 5,889,493 | A | 3/1999 | Endo |
| 6,008,763 | A | 12/1999 | Nyström et al. |
| 6,239,752 | B1 | 5/2001 | Blanchard |
| 6,272,349 | B1 | 8/2001 | McGrath et al. |

(Continued)

FOREIGN PATENT DOCUMENTS

| | | |
|---|---|---|
| EP | 0901182 | 3/1999 |
| JP | 11-346168 | 12/1999 |

OTHER PUBLICATIONS

International Search Report and Written Opinion dated Feb. 29, 2016 for PCT Application No. PCT/US2015/056823 filed Oct. 22, 2015 which claims priority to the same parent application as the instant application; 9 pages.

(Continued)

*Primary Examiner* — Dameon E Levi
*Assistant Examiner* — Collin Dawkins
(74) *Attorney, Agent, or Firm* — Harness, Dickey & Pierce, P.L.C.

(57) ABSTRACT

Disclosed herein are exemplary embodiments of multilayer printed circuit board assemblies (PCBAs) that integrally define or include patch antenna radiating elements. The radiating elements may be defined or formed from electrically-conductive layers of the PCBAs. Also disclosed herein are exemplary embodiments of antenna assemblies, systems, or modules comprising such multilayer PCBAs.

20 Claims, 11 Drawing Sheets

(56) References Cited

U.S. PATENT DOCUMENTS

| | | | | |
|---|---|---|---|---|
| 6,466,131 | B1 | 10/2002 | Tuttle et al. | |
| 7,295,167 | B2 | 11/2007 | Aminzadeh et al. | |
| 2005/0069277 | A1* | 3/2005 | Nakazawa | G01S 7/032 385/147 |
| 2007/0052589 | A1 | 3/2007 | Liu | |
| 2008/0068268 | A1 | 3/2008 | Kowalewicz et al. | |
| 2009/0102728 | A1 | 4/2009 | Gamand | |
| 2012/0119954 | A1 | 5/2012 | Chen | |
| 2013/0093641 | A1* | 4/2013 | Ng | H01Q 1/521 343/841 |
| 2014/0240175 | A1 | 8/2014 | Suzuki et al. | |
| 2014/0313069 | A1* | 10/2014 | Tseng | G01S 7/032 342/175 |

OTHER PUBLICATIONS

"Jupiter" Global Positioning System (GPS) Receiver (Part No. TU30-D140-221/231), Rockwell Semiconductor Systems Data Sheet; Order No. GD003E, Jan. 19, 1998, 18 pages.

GPS Sensors for a Variety of Applications, Harumasa Hojo et al., Japan Radio Co., Ltd., Sep. 20-23, 1994, 11 pp. 1087-1095.

Trimble Force GPS; The GPS Force Multiplier, Military Products, Copyright Dec. 1994 Trimble Navigation, 2 pages.

Tidget™ Plus: Urban Navigation With Stand-Alone GPS; Alison Brown, NAVSYS Corporation, Sep. 1993, 8 pages.

Motorola Introduces SL Oncore™ Smallest www Oncore™ Line of GPS Receivers, www.uadrones.net/systems/research/1998/0511.htm; printed Feb. 16, 2014; 1 page.

* cited by examiner

PATCH ANTENNA ASSEMBLIES

CROSS-REFERENCE TO RELATED APPLICATION

This application claims the benefit of and priority to U.S. Provisional Application No. 62/067,313 filed Oct. 22, 2014. The entire disclosure of the above application is incorporated herein by reference.

FIELD

The present disclosure relates to patch antenna assemblies.

BACKGROUND

This section provides background information related to the present disclosure which is not necessarily prior art.

Different types of antennas are used in the automotive industry, including AM/FM radio antennas, satellite digital audio radio service antenna (SDARS), cellular phone antennas, satellite navigation antennas, etc.

Automotive antennas may be mounted inside or outside of a vehicle. For example, a satellite navigation antenna may be mounted on an exterior vehicle surface, such as the roof, trunk, or hood of the vehicle to help ensure that the antenna has unobstructed views overhead or toward the zenith. As another example, a satellite navigation antenna may be mounted inside an instrument panel of the vehicle. The satellite navigation antenna may be connected to one or more electronic devices (e.g., an in-dash touchscreen display, etc.) inside the passenger compartment of the vehicle.

FIG. 1 illustrates a conventional antenna assembly 100 including a patch antenna 104, a printed circuit board assembly (PCBA) 108, and an electromagnetic interference (EMI) shield 112. As shown, the conventional patch antenna 104 includes a radiating element, antenna structure, or radiator 116 on a top surface of a first dielectric substrate 120. The first dielectric ceramic substrate 120 is positioned to be mounted on top of a second dielectric substrate or board of the PCBA 108.

The antenna assembly 100 also includes a connector 124 for electrically connecting the PCBA 108 to a communication link, which, in turn, may be connected to an electronic device (e.g., an in-dash touchscreen display, etc.) inside the passenger compartment of a vehicle. The antenna assembly 100 includes a cover or housing 128 that may be coupled to (e.g., snapped together with, latched to, etc.) a base 132. Bumpers 136 are positioned between the PCB 108 and the cover 128.

The patch antenna 104 may be electrically connected or coupled to the PCBA 108 via a connector 118. The connector 118 may comprise an uninsulated pin or an insulated pin (e.g., a metal conductor with an EMI shield around it, etc.). The pin may be a semi-rigid pin and extend from the top of the patch antenna 104 through the patch's radiating element 116 and first dielectric substrate 120 to the PCBA 108.

A label 190 may be adhesively attached to an outer surface of the cover 128. The label 190 may include information for identifying the particular antenna assembly.

FIG. 2 illustrates another conventional antenna assembly 200 including a patch antenna 204 and a PCBA 208. As shown in FIG. 2, the conventional patch antenna 204 includes a radiating element 216 on a top surface of a first dielectric ceramic substrate 220. The first dielectric ceramic substrate 220 is mounted on top of a second dielectric substrate or board of the PCBA 208. The antenna assembly 200 also includes a connector 224 for electrically connecting the PCBA 208 to a communication link, which, in turn, may be connected to an electronic device (e.g., an in-dash touchscreen display, etc.) inside the passenger compartment of a vehicle.

The patch antenna 204 may be electrically connected or coupled to the PCBA 208 via a connector 218. The connector 218 may comprise an uninsulated pin or an insulated pin (e.g., a metal conductor with an EMI shield around it, etc.). The pin may be a semi-rigid pin and extend from the top of the patch antenna 204 through the patch's radiating element 216 and first dielectric substrate 220 to the PCBA 208.

SUMMARY

This section provides a general summary of the disclosure, and is not a comprehensive disclosure of its full scope or all of its features.

Disclosed herein are exemplary embodiments of multilayer printed circuit board assemblies (PCBAs) that integrally define or include patch antenna radiating elements. The radiating elements may be defined or formed from electrically-conductive layers of the PCBAs. Also disclosed herein are exemplary embodiments of antenna assemblies, systems, or modules comprising such multilayer PCBAs.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
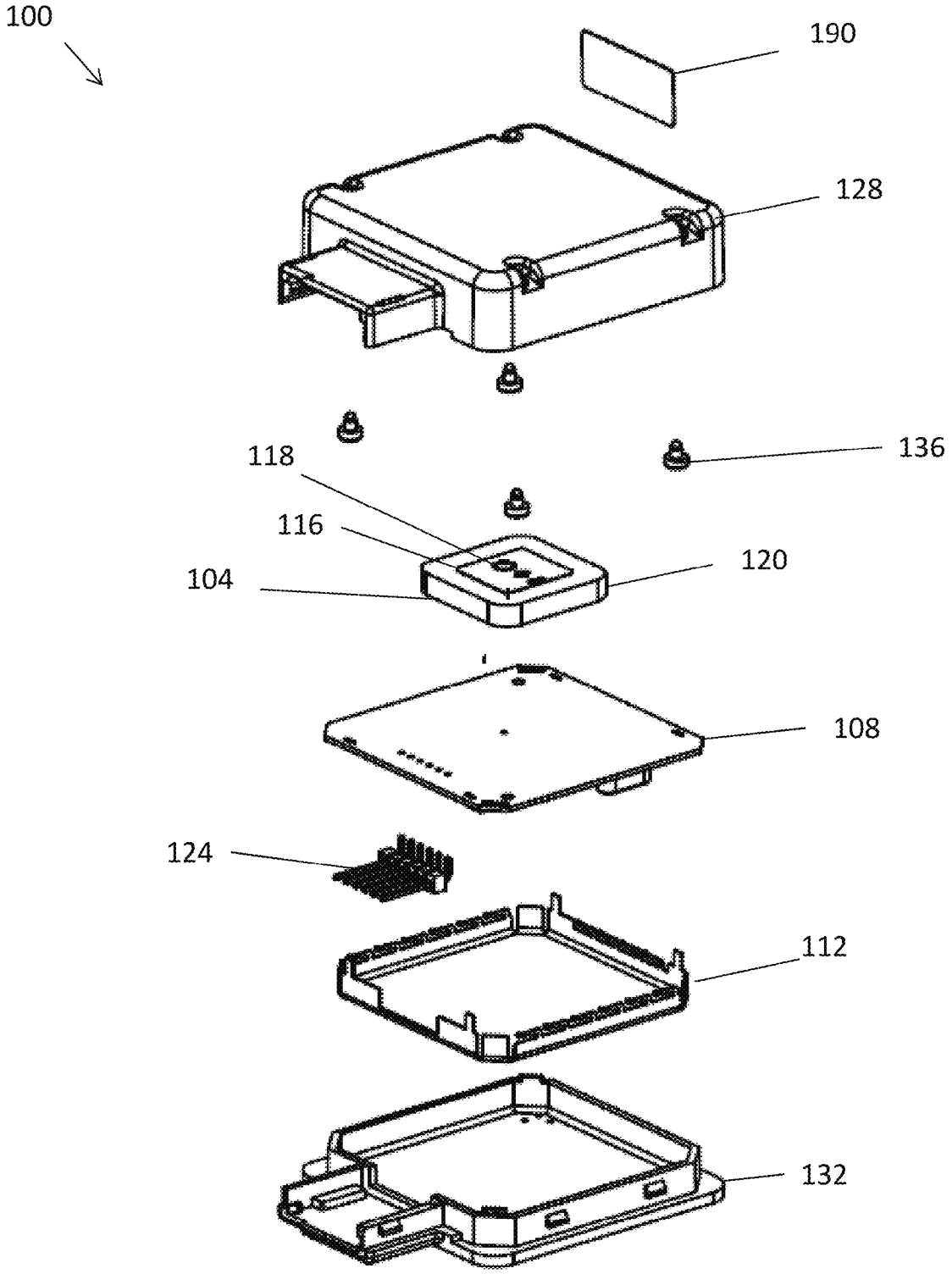
FIG. 1 (prior art)
FIG. 1 is an exploded perspective view of a conventional antenna assembly including a patch antenna having a radiating element on a dielectric substrate, where the patch antenna's dielectric substrate is positioned to be mounted to a separate dielectric substrate or board of a printed circuit board assembly (PCBA)

Example embodiments will now be described more fully with reference to the accompanying drawings.

Disclosed herein are exemplary embodiments of multilayer printed circuit board assemblies (PCBAs) (e.g., 308 (FIGS. 3-5), etc.) that integrally define or include patch antenna radiating elements. The radiating elements may be defined or formed from electrically-conductive layers of the PCBAs. Also disclosed herein are exemplary embodiments of antenna assemblies, systems, or modules (e.g., 300 (FIGS. 6-14), etc.) comprising such multilayer PCBAs.

In exemplary embodiments, a radiating element is an integral part of (e.g., integrally defined by one or more electrically-conductive layers of a PCBA, etc.) of a multilayer PCBA. For example, a radiating element (e.g., $\lambda/2$-antenna structure, generally rectangular patch with a pair of truncated opposite corners, etc.) may comprise a top or first electrically-conductive (e.g., metal, metallic, alloy, composite material, etc.) layer of a multilayer PCBA.

A low noise amplifier (LNA) may be disposed generally underneath the radiating element. For example, the LNA may be surface mounted (e.g., soldered, etc.) directly to a second or bottom dielectric (e.g., ceramic, etc.) layer of the multilayer PCBA such that the LNA is part of the PCBA. The LNA components may be on the bottom of the PCBA, along with signal processing components, such as a microcontroller, a module, a chip, etc. In addition to the LNA, one or more additional components (e.g., one or more microcontrollers, modules, chips, etc.) may be populated directly to (e.g., surface mounted, soldered, etc.) the bottom dielectric layer of the multilayer PCBA. The multilayer PCBA further defines or includes electrically-conductive printed traces interconnected by electrically-conductive vias or plated thru-holes (e.g., FIG. 5, etc.). The surface mounted components may be interconnected through the interconnecting traces and vias.

A ground element or ground plane (e.g., copper, etc.) may also be an integral part of (e.g., integrally defined by one or more electrically-conductive layers, etc.) of the multilayer PCBA. For example, the ground may comprise an inner or intermediate electrically-conductive (e.g., metal, metallic, alloy, composite material, etc.) layer of the multilayer PCBA. The inner layer defining the ground may be disposed between the top or first layer defining the radiating element and the second or bottom dielectric layer to which the LNA is surface mounted. In an exemplary embodiment, the multilayer PCBA includes a top etched patch radiating element (e.g., etched copper foil or sheet, etc.), a first or upper core, a second or lower core, and prepreg between the first and second cores. A patch ground plane and one or more internal signal layer(s) (1-99) may be disposed or embedded within the prepreg. In alternative embodiments, the multilayer PCB may include one more additional electrically-conductive layers (e.g., copper or other metal foil, sheet, or layer, etc.), one or more additional dielectric layers (e.g., prepreg, FR2, FR4, polytetrafluoroethylene (PTFE), polyimide, etc.), and/or additional alternating layers of dielectric and electrically-conductive layers.

Figure 2:
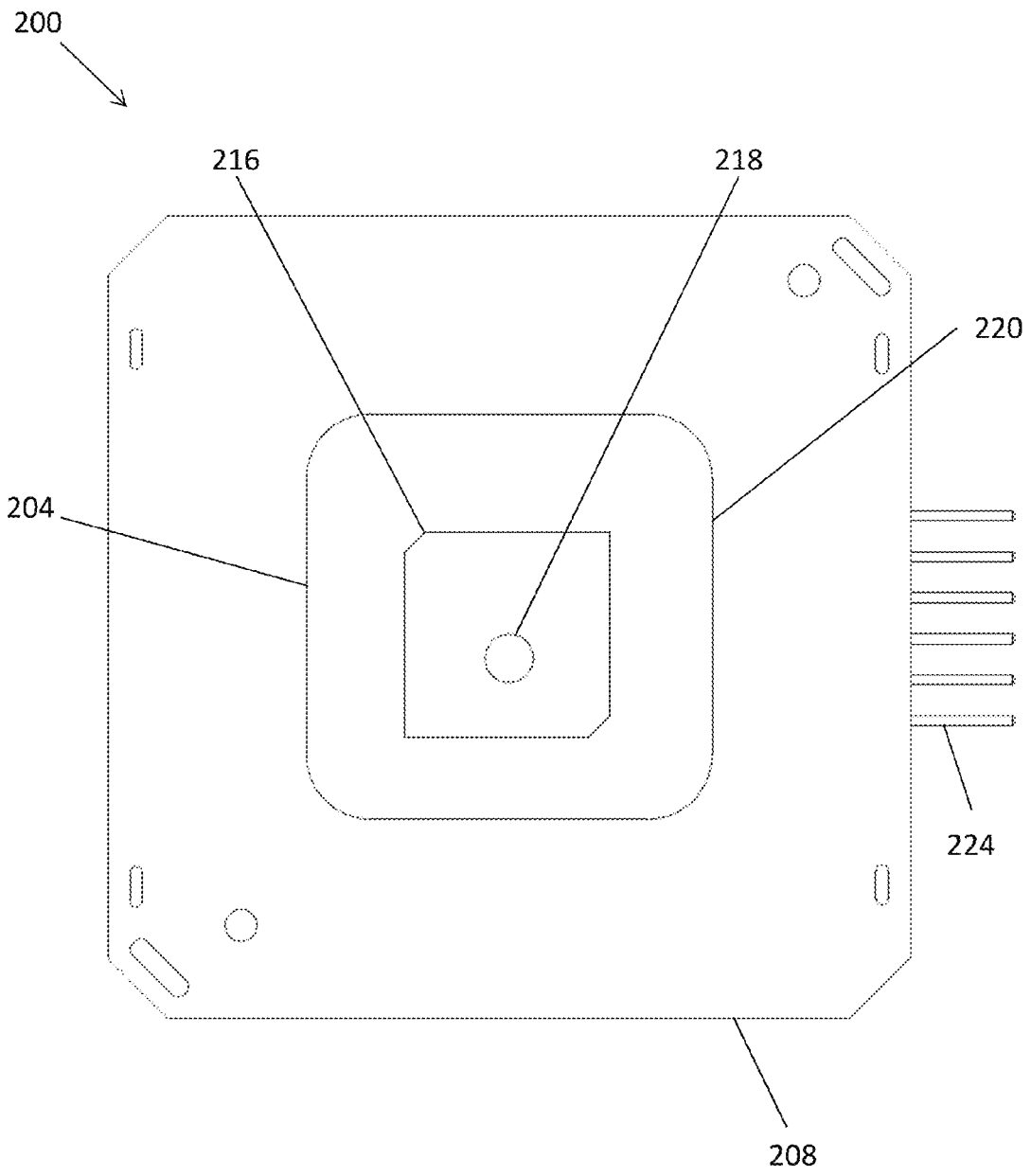
FIG. 2 (prior art)
FIG. 2 is a top plan view of another conventional antenna assembly including a patch antenna having a radiating element on a dielectric substrate, where the patch antenna's dielectric substrate is mounted to a separate dielectric substrate or board of a PCBA.

In exemplary embodiments, the patch radiating element and the low noise amplifier are parts of the same multilayer PCBA such that the patch radiating element is not a separate component that must be individually installed (e.g., soldered, adhesively attached, etc.) to the board or substrate of the PCBA. This is unlike the conventional patch antennas 104, 204 respectively shown in FIGS. 1 and 2, where the patch antennas 104, 204 include their own dielectric substrate 120, 220, respectively, that are installed to the board of the PCBA 108, 208. In exemplary embodiments disclosed herein, the patch antenna is integral to or integrated with the multilayer PCBA. Because the patch antenna is an integral part of the multilayer PCBA, the patch antenna does not include its own separate dielectric substrate that must be mounted separately to the PCBA. Accordingly, exemplary embodiments disclosed herein allow for the elimination of the separate dielectric substrate that a conventional patch antenna includes as well as the costs and installation process for assembling the conventional patch antenna and its separate dielectric substrate to the PCBA.

The patch radiating element of the multilayer PCBA may be configured for operation with a particular frequency or within a particular frequency range depending on the intended end use of the antenna assembly. For example, exemplary embodiments may include a patch antenna or radiating element configured to be operable with one or more satellite navigation frequency bands (e.g., GNSS, global positioning system (GPS), global navigation satellite system (GLONASS), Doppler Orbitography and Radiopositioning Integrated by Satellite (DORIS), BeiDou Navigation Satellite System (BDS), etc.) and/or satellite digital audio radio services (SDARS) (e.g., Sirius XM Satellite Radio, etc.), etc.

Figure 3:
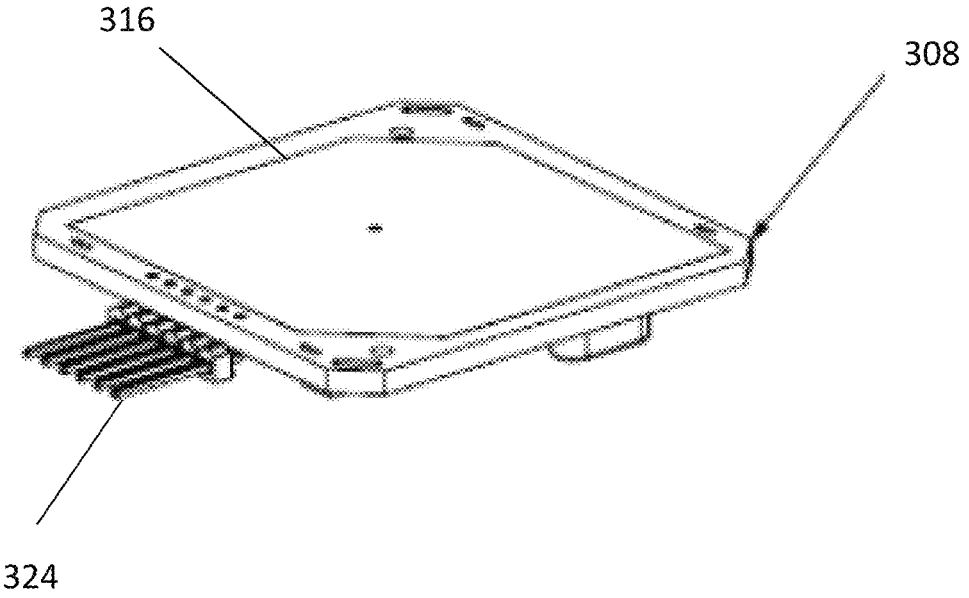
FIG. 3 is a perspective view of an multilayer printed circuit board assembly (PCBA) that integrally defines or includes a patch antenna radiating element according to an exemplary embodiment.
Figure 4:
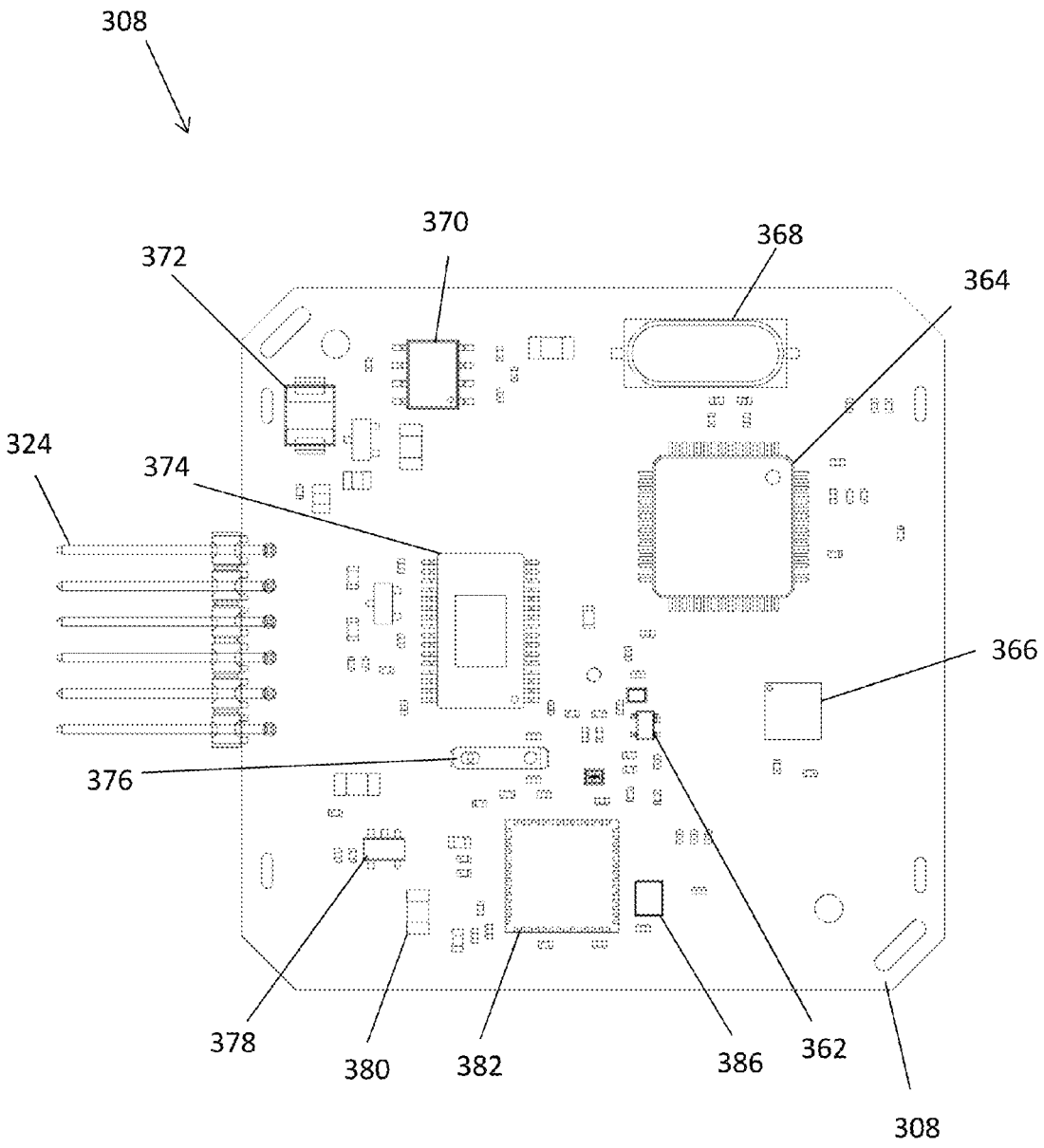
FIG. 4 is a bottom plan view of the PCBA shown in FIG. 3, and showing example components populated directly on a bottom dielectric substrate or layer of the multilayer PCBA according to an exemplary embodiment.
Figure 5:
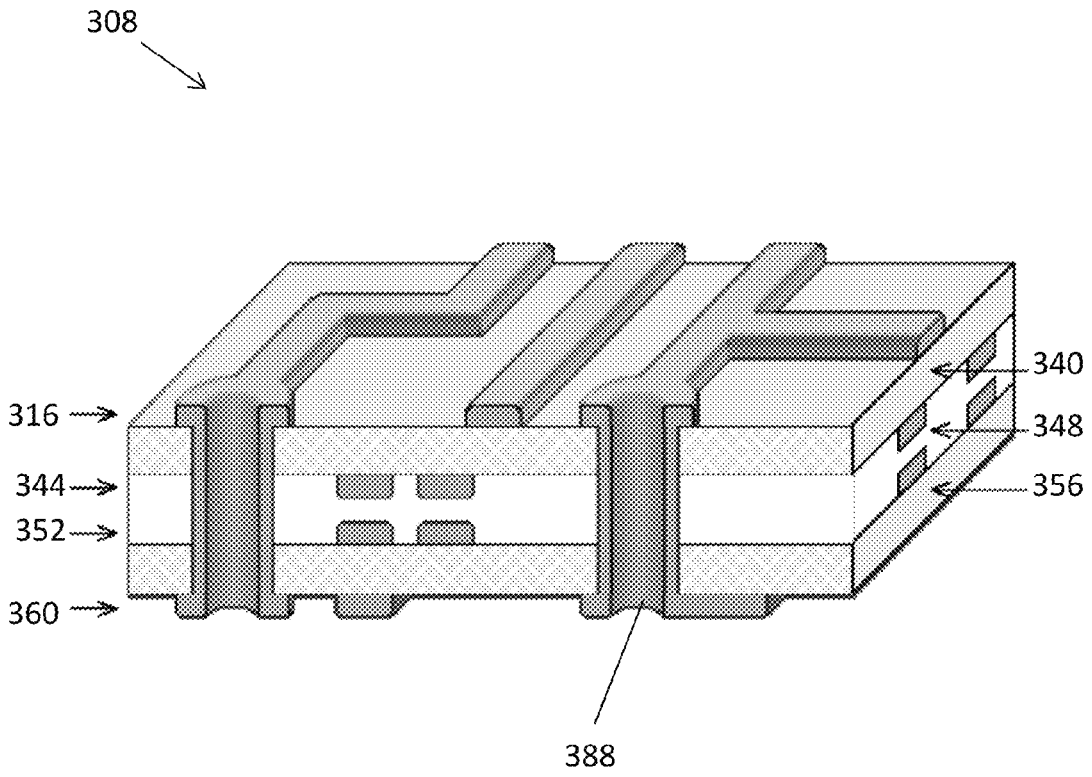
FIG. 5 shows an example layer stack-up that may be used for the PCBA shown in FIG. 3 according to an exemplary embodiment.

With reference to the figures, FIGS. 3-5 illustrates an exemplary embodiment of a multilayer printed circuit board assembly (PCBA) 308 embodying one or more aspects of the present disclosure. As shown in FIG. 3, the multilayer PCBA 308 includes a patch antenna radiating element 316. The patch radiating element 316 is defined or formed from an electrically-conductive layer of the PCBA 308.

As shown in FIG. 5, the patch radiating element 316 comprises a top etched patch element above a first or upper core layer 340 of the multilayer PCBA 308. The patch radiating element 316 may be formed by etching a top layer of copper that is disposed on the first or upper core layer 340. The multilayer PCBA 308 also includes a ground element or ground plane 344 for the patch element 316. The ground plane 344 is also an integral part of the multilayer PCBA 308. The ground plane 344 may be integrally defined by one or more electrically-conductive layers of the multilayer PCBA 308.

With continued reference to FIG. 5, the multilayer PCBA 308 further includes prepreg 348, internal signal layer(s) (1-99) 352, a second or lower core layer 356, and a bottom component layer 360. In alternative embodiments, the multilayer PCB may include more or less layers, such as one or more additional electrically-conductive layers, one or more additional dielectric layers, and/or additional alternating layers of dielectric and electrically-conductive layers.

By way of example only, an exemplary process for making a multilayer PCBA comprises sandwiching together, under high temperature and pressure, alternating layers of copper foil and dielectric material. The dielectric material may include prepreg and core material, such as FR2, FR4, polytetrafluoroethylene (PTFE), polyimide, etc. Pressure is used to squeeze out air, while heat is used to melt and cure a thermosetting "prepreg" adhesive, which holds the multilayer PCBA together. FR4 is an epoxy-bounded fiberglass composite material that includes woven fiberglass cloth with an epoxy resin binder that is flame resistant. FR2 is a composite material that includes paper impregnated with a plasticized phenol formaldehyde resin.

The bottom component layer 360 may comprise various components (e.g., signal processing components, LNA components, a microcontroller, a module, a chip, etc.) that are coupled to (e.g., surface mounted on, etc.) the second or lower core layer 356 of the PCBA 308. For example, LNA components may be surface mounted to the second or lower core layer 356 of the multilayer PCBA 308 such that the LNA is part of the PCBA 308. The LNA may be a one stage amplifier chip (e.g., a BFP640 one stage amplifier chip from Infineon, etc.) with a filter and supporting hardware. Or, for example, the LNA may comprise a more complicated three stage amplifier with a filter and its supporting hardware, etc. The bottom component layer 360 also includes one or more additional components (e.g., one or more microcontrollers, modules, chips, etc.) populated directly to (e.g., surface mounted on, etc.) the second core layer 356 of the multilayer PCBA 308.

In this example embodiment of FIG. 4, the multilayer PCBA 308 includes an LNA 362 comprising an amplifier chip, a filter, and passive components. FIG. 4 also shows a microcontroller 364 (e.g., a Renesas UPD70F3624 Microcontroller, etc.), a gyroscope 366 (e.g., an ST Microsystems A3G4250D gyroscope, etc.), a crystal 368, voltage regulator 370, diode 372, CAN (controller area network) transceiver 374 (e.g., NXP JJA1076 CAN transceiver, etc.), a crystal (clock) 376, a 2.8V Regulator 378, a capacitor 380, a GPS receiver 382 (e.g., Ublox UBX-G6010 ST GPS receiver, etc.) and a crystal 386. These components 362 through 386 are examples only as other exemplary embodiments may include more, less, or different components than what is shown in FIG. 4.

The multilayer PCBA 308 further defines or includes electrically-conductive printed traces interconnected by electrically-conductive vias 388 (FIG. 5). The interconnecting traces and vias 388 may electrically connect the patch antenna element 316 to the surface mounted components on the opposite side of the PCBA 308. Accordingly, this exemplary embodiment doesn't require the separate pin 118 (FIG. 1) or 218 (FIG. 2) used in conventional patch antennas 100 or 200 to electrically connect a patch antenna element to a PCBA.

The patch antenna element 316 of the multilayer PCBA 308 may be configured for operation with a particular frequency or within a particular frequency range depending on the intended end use. For example, the patch antenna element 316 may be configured (e.g., sized, shaped, etc.) to be operable with global positioning system (GPS) frequencies. Other exemplary embodiments may include a patch antenna element configured to be operable with one or more other or additional satellite navigation frequency bands (e.g., GNSS, global navigation satellite system (GLONASS), Doppler Orbitography and Radio-positioning Integrated by Satellite (DORIS), BeiDou Navigation Satellite System (BDS), etc.) and/or with satellite digital audio radio services (SDARS) (e.g., Sirius XM Satellite Radio, etc.), etc.

Figure 6:
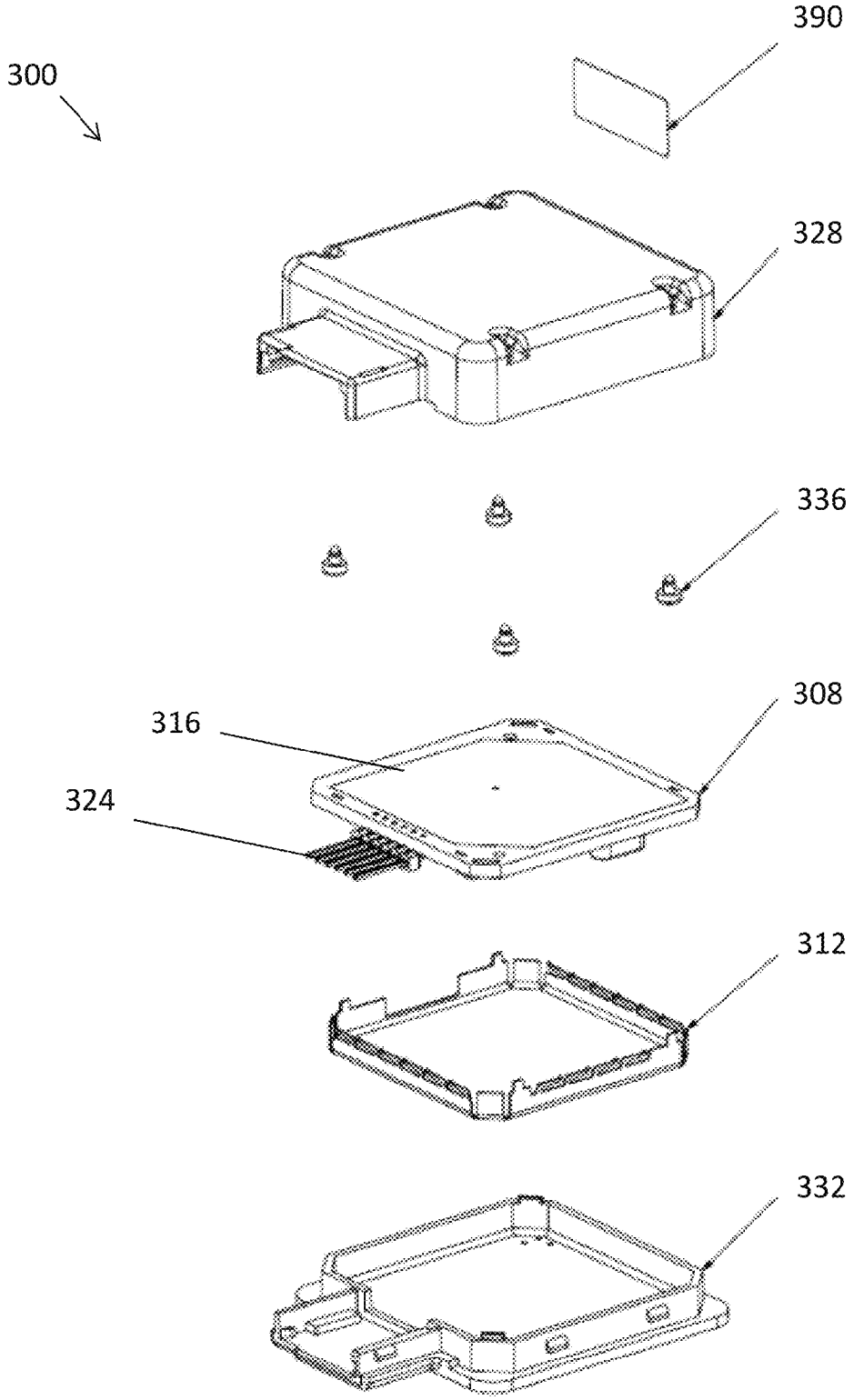
FIG. 6 is an exploded perspective view of an antenna assembly including the PCBA shown in FIGS. 3 and 4, and also illustrating an example base, EMI shield or spacer, bumpers, cover, and label according to an exemplary embodiment.
Figure 7:
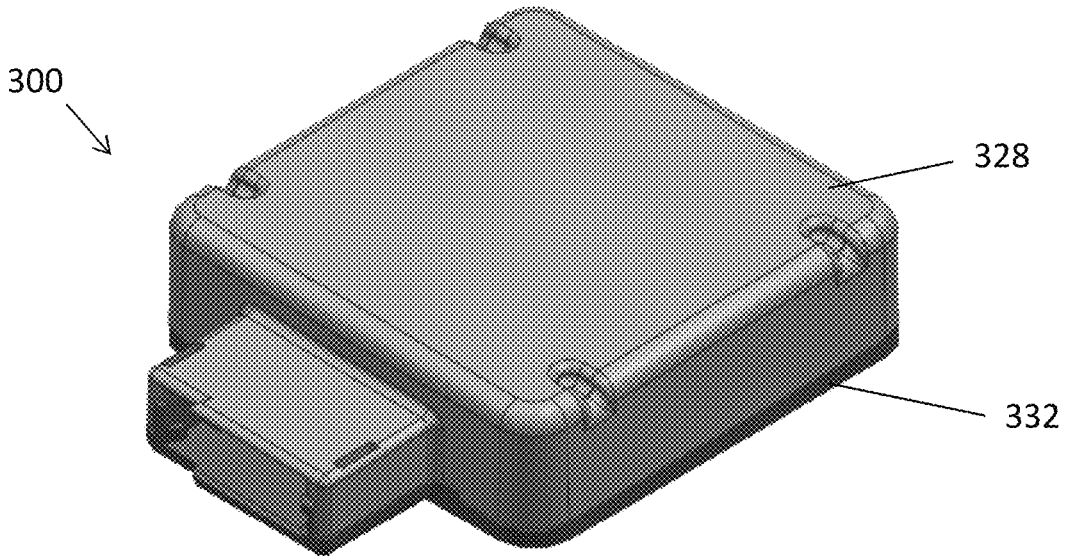
FIG. 7 is a perspective view of the antenna assembly shown in FIG. 6 after being assembled together.
Figure 8:
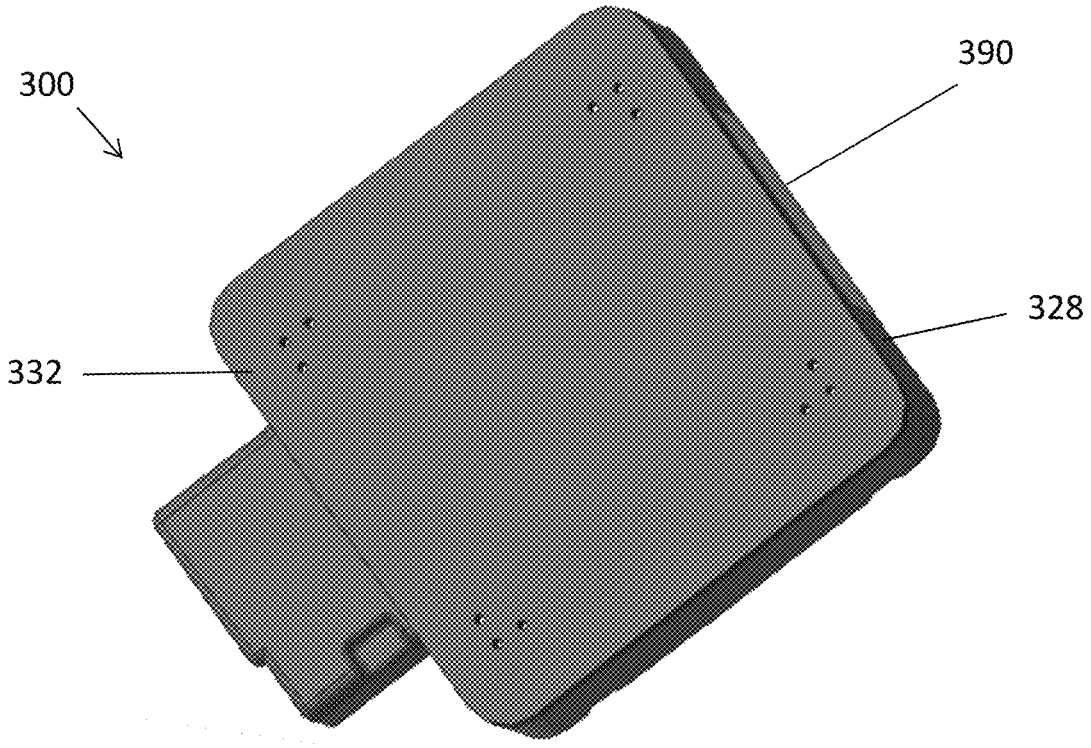
FIG. 8 is a bottom perspective view of the antenna assembly shown in FIG. 7.
Figure 9:
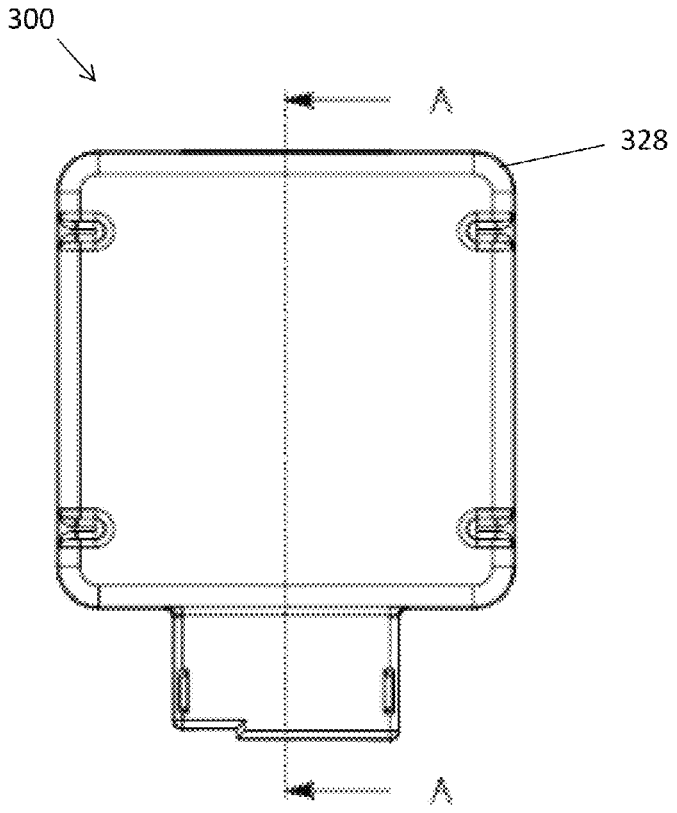
FIG. 9 is a top plan view of the antenna assembly shown in FIG. 7.
Figure 10:
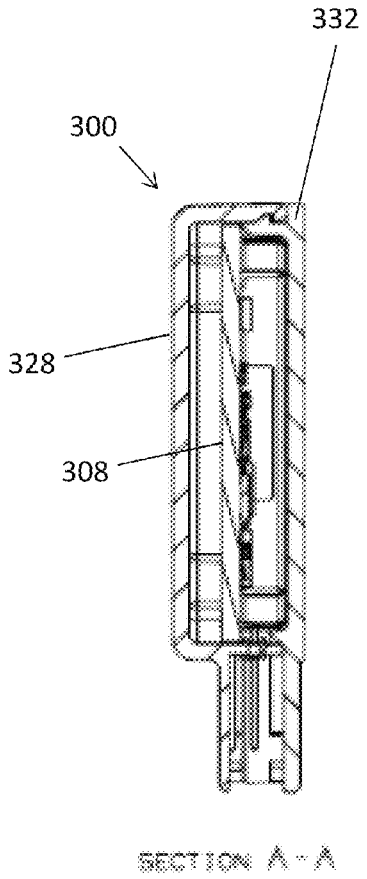
FIG. 10 is a cross-sectional view of the antenna assembly taken along the line A-A shown in FIG. 9.
Figure 11:
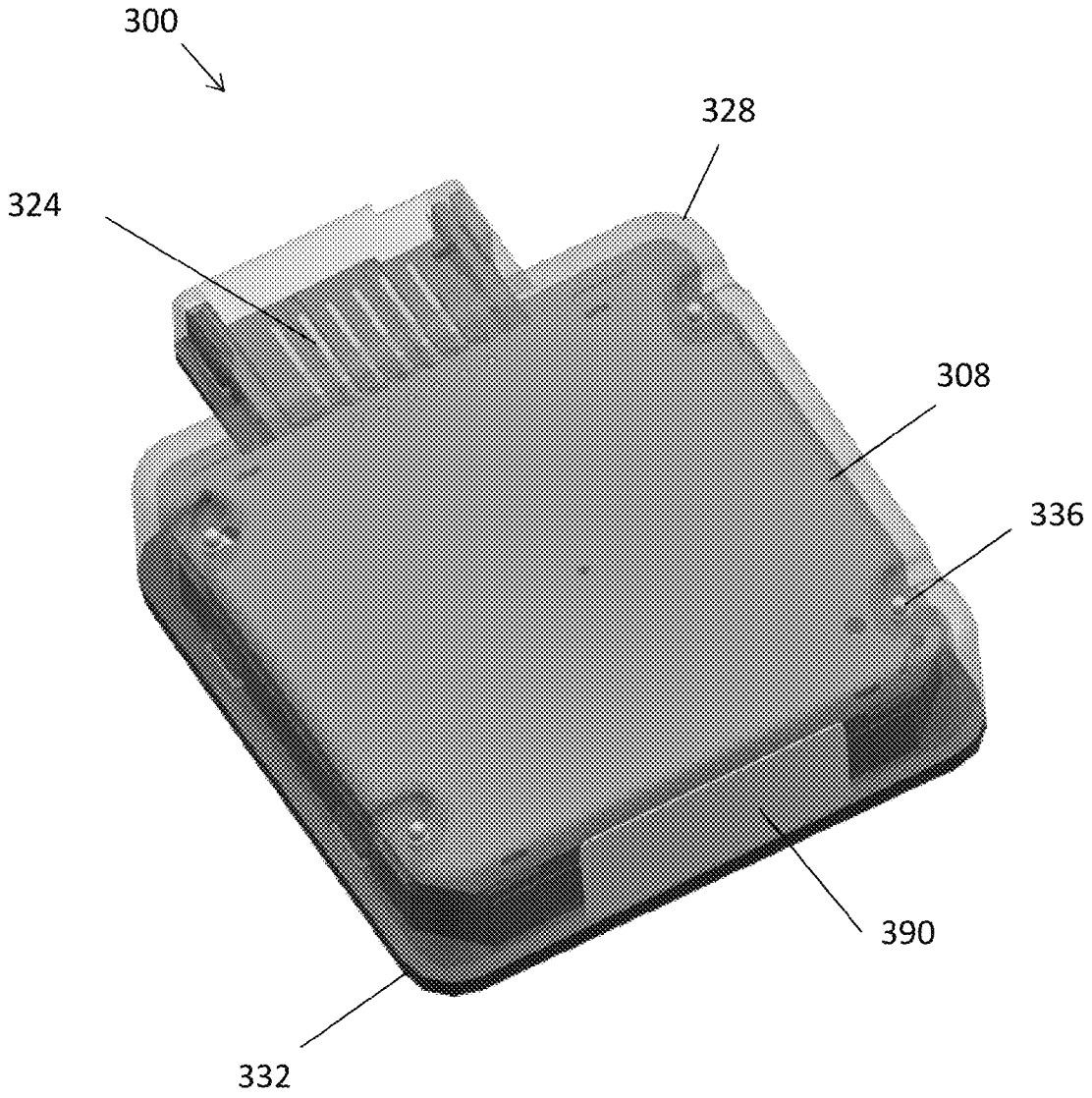
FIG. 11 is a perspective view of the antenna assembly shown in FIG. 7 where the cover is see-through for purposes of showing the PCBA under the cover.
Figure 12:
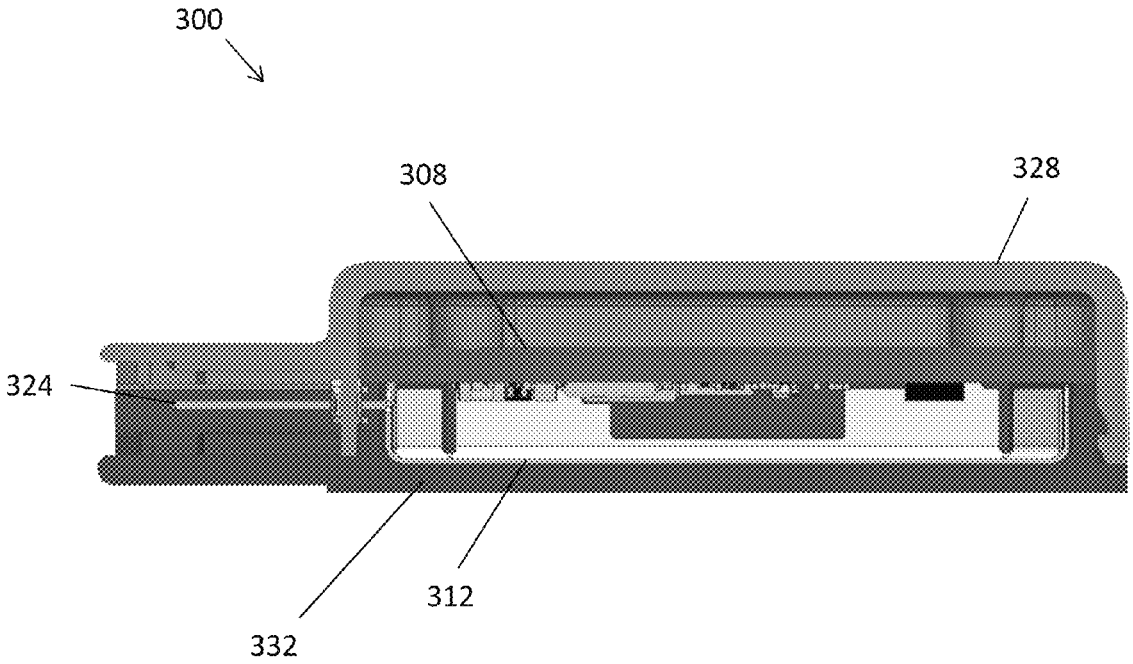
FIG. 12 is a cross-sectional side view of the antenna assembly shown in FIG. 11.
Figure 13:
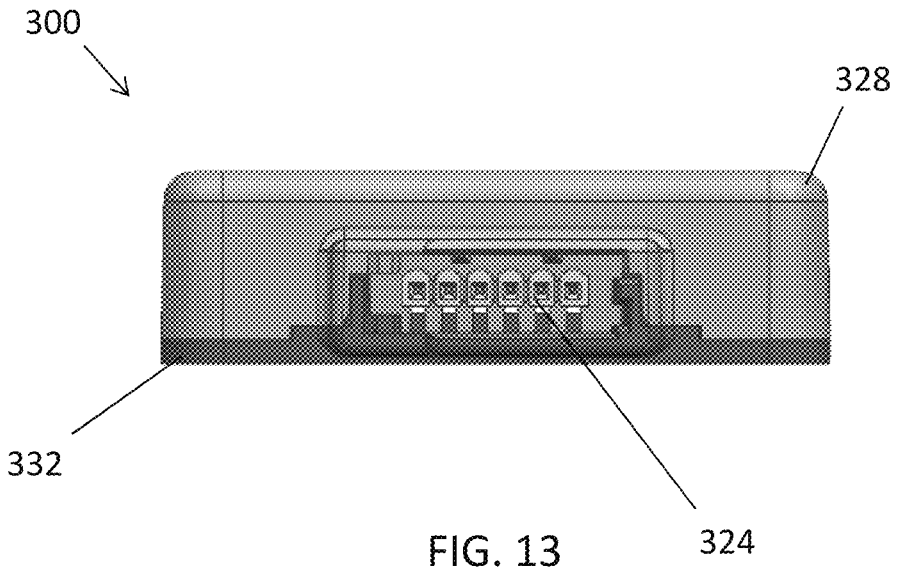
FIG. 13 is a front view of the antenna assembly shown in FIG. 7.
Figure 14:
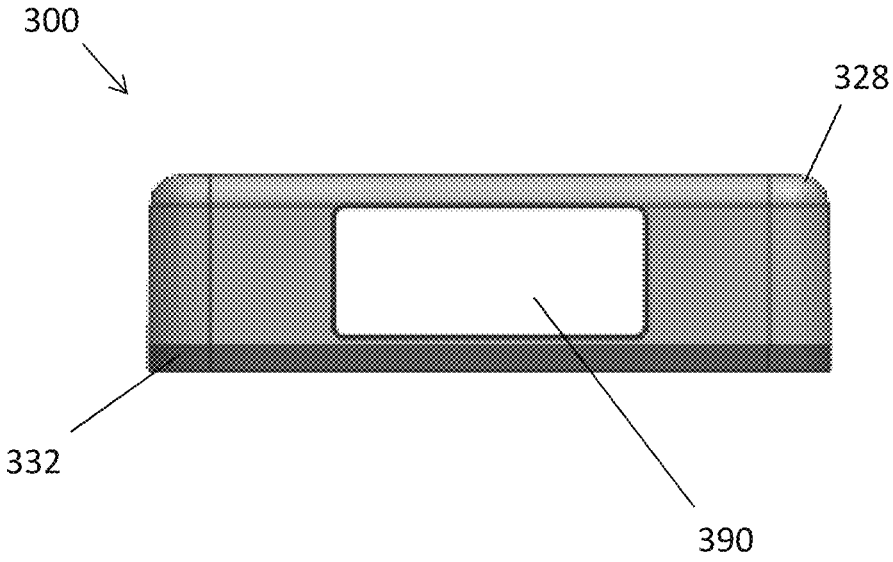
FIG. 14 is a back view of the antenna assembly shown in FIG. 7.

FIGS. 6-14 illustrates an exemplary embodiment of an antenna assembly 300 embodying one or more aspects of the present disclosure. As shown in FIG. 6, the antenna assembly 300 includes the multilayer printed circuit board assembly (PCBA) 308 shown in FIGS. 3-5. As disclosed herein, the multilayer PCBA 308 integrally defines or includes the patch antenna radiating element 316. LNA and signal processing components may also be populated directly on (e.g., surface mounted to, etc.) the second core layer 356 of the PCBA 308, to thereby define the bottom component layer 360 of the multilayer PCBA 308.

As shown in FIG. 6, the antenna assembly 300 also includes a connector 324 for electrically connecting the PCBA 308 to a communication link, which, in turn, may be connected to an electronic device (e.g., an in-dash touch-screen display, etc.) inside the passenger compartment of a vehicle. The connector 324 may comprise a six pin connector (e.g., Molex six pin right angle header connector, etc.) or other suitable connector.

The antenna assembly 300 also includes an EMI shield 312. In this example, the EMI shield 312 comprises stamped sheet metal including resilient spring fingers along the side walls. The EMI shield 312 also includes tabs that extend through guide holes in the PCBA 308.

The antenna assembly 300 includes a housing or cover 328. The cover 328 may be coupled to (e.g., snapped together with, latched to, etc.) a base 332 such that the cover 328 and base 332 cooperatively define an interior for housing the PCBA 308 therein. The cover 328 and base 332 may be formed from a dielectric material, e.g., plastic, etc.

A label 390 may be adhesively attached to an outer surface of the cover 328. The label 390 may include information for identifying the particular antenna assembly.

Resiliently compressible (e.g., silicone, etc.) bumpers 336 may be positioned between the PCBA 308 and the cover 328. The bumpers 336 are compressively sandwiched generally between the PCBA 308 and cover 328 when the cover 328 is coupled to the base 332. Compression of the bumpers 336 generates a compressive force urging the PCBA 308 generally towards EMI shield 312 that aids in electrically grounding of the PCBA 308 with the EMI shield 312.

The antenna assembly 300 may be mounted inside or outside of a vehicle. For example, the antenna assembly 300 may be mounted on an exterior vehicle surface, such as the roof, trunk, or hood of the vehicle to help ensure that the antenna has unobstructed views overhead or toward the zenith. As another example, the antenna assembly 300 may be mounted inside an instrument panel of the vehicle.

Depending on the intended end use of the antenna assembly 300, the patch radiating element may be configured for operation with a particular frequency or within a particular frequency range. For example, exemplary embodiments may include a patch antenna structure, radiating element, or radiator configured to be operable with one or more satellite navigation frequency bands (e.g., GNSS, global positioning system (GPS), global navigation satellite system (GLONASS), Doppler Orbitography and Radio-positioning Integrated by Satellite (DORIS), BeiDou Navigation Satellite System (BDS), etc.), satellite digital audio radio services (SDARS) (e.g., Sirius XM Satellite Radio, etc.), etc.

By way of further example, exemplary embodiments may include a patch antenna structure, radiating element, or radiator configured to be operable in one or more other frequency bands associated with, e.g., Wi-Fi, DSRC (Dedicated Short Range Communication), satellite signals, terrestrial signals, DAB-L, Wi-Fi, Wi-Max, etc.

Exemplary embodiments are disclosed herein of printed circuit board assemblies (PCBAs) and antenna assemblies that may provide one or more (but not necessarily any or all) of the following advantages or benefits as compared to some existing antenna assemblies. Conventionally, patch antennas include a radiating element on top of a first dielectric substrate, which is mounted to a second dielectric substrate, i.e., the PCBA of the antenna assembly. But in exemplary embodiments disclosed herein, the patch antenna is integral to or integrated with a multilayer PCBA. Because the patch antenna is an integral part of the multilayer PCBA, the patch antenna does not include its own separate dielectric substrate that must be mounted separately to the multilayer PCBA. Instead, the multilayer PCBA includes the patch radiating element. Accordingly, exemplary embodiments disclosed herein allow for the elimination of the separate dielectric substrates that conventional patch antennas include as well as the costs and installation process for assembling the conventional patch antenna and its separate dielectric substrate to the PCB.

In addition, antenna assemblies disclosed herein may be mounted to a wide range of supporting structures, including stationary platforms and mobile platforms. For example, an antenna assembly disclosed herein could be mounted to supporting structure of a bus, train, aircraft, bicycle, motor cycle, boat, among other mobile platforms. Accordingly, specific references to motor vehicles or automobiles herein should not be construed as limiting the scope of the present disclosure to any specific type of supporting structure or environment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A printed circuit board assembly consisting essentially of:

a patch antenna element integrally defined by the printed circuit board assembly along an upper surface of the printed circuit board assembly, wherein the patch antenna element is generally rectangular including a pair of truncated opposite corners;

one or more components along a lower surface of the printed circuit board assembly; wherein the printed circuit board assembly comprises a multilayer printed circuit board assembly including:

a top layer of electrically-conductive material etched to integrally define the patch antenna element;

a bottom component layer including the one or more components;

a first core layer defining the upper surface along which the patch antenna element is disposed;

a second core layer defining the lower surface along which the one or more components are disposed;

prepreg between the first and second core layers;

a ground plane integrally defined by an inner electrically-conductive layer of the printed circuit board assembly, wherein the ground plane is between the first core layer defining the upper surface along which the patch antenna element is disposed and the second core layer defining the lower surface along which the one or more components are disposed.

2. The printed circuit board assembly of claim 1, wherein the patch antenna element configured to be operable with one or more satellite navigation frequency bands or satellite digital audio radio services.

3. The printed circuit board assembly of claim 1, wherein the one or more components comprise a low noise amplifier surface mounted to the lower surface of the printed circuit board assembly, whereby the low noise amplifier and the patch antenna element are parts of the same printed circuit board assembly.

4. The printed circuit board assembly of claim 1, wherein the one or more components comprise a low noise amplifier, a microcontroller, a gyroscope, a receiver, and a controller area network transceiver.

5. A printed circuit board assembly consisting essentially of:

a patch antenna element integrally defined by the printed circuit board assembly along an upper surface of the printed circuit board assembly, wherein the patch antenna element is generally rectangular including a pair of truncated opposite corners;

one or more components along a lower surface of the printed circuit board assembly;

wherein the printed circuit board assembly comprises a multilayer printed circuit board assembly including:

a top layer of electrically-conductive material etched to integrally define the patch antenna element;

a bottom component layer including the one or more components;

a first core layer defining the upper surface along which the patch antenna element is disposed;

a second core layer defining the lower surface along which the one or more components are disposed;

prepreg between the first and second core layers;

a ground plane for the patch antenna element within the prepreg and between the first core layer defining the upper surface along which the patch antenna element is disposed and the second core layer defining the lower surface along which the one or more components are disposed; and one or more internal signal layers within the prepreg and between the ground plane and the second core layer.

6. A printed circuit board assembly consisting essentially of:

a patch antenna element integrally defined by the printed circuit board assembly along an upper surface of the printed circuit board assembly, wherein the patch antenna element is generally rectangular including a pair of truncated opposite corners;

one or more components along a lower surface of the printed circuit board assembly;

wherein the printed circuit board assembly comprises a multilayer printed circuit board assembly including:

a top layer of electrically-conductive material etched to integrally define the patch antenna element;

a bottom component layer including the one or more components;

a first core layer defining the upper surface along which the patch antenna element is disposed;

a second core layer defining the lower surface along which the one or more components are disposed;

prepreg between the first and second core layers;

a ground plane integrally defined by an inner electrically-conductive layer of the printed circuit board assembly, wherein the ground plane is between the first core layer defining the upper surface along which the patch antenna element is disposed and the second core layer defining the lower surface along which the one or more components are and one or more internal signal layers within the prepreg.

7. A printed circuit board assembly consisting essentially of:

a patch antenna element integrally defined by the printed circuit board assembly along an upper surface of the printed circuit board assembly, wherein the patch antenna element is generally rectangular including a pair of truncated opposite corners;

one or more components along a lower surface of the printed circuit board assembly; wherein the printed circuit board assembly comprises a multilayer printed circuit board assembly including:

a top layer of electrically-conductive material etched to integrally define the patch antenna element;

a bottom component layer including the one or more components;

a first core layer defining the upper surface along which the patch antenna element is disposed;

a second core layer defining the lower surface along which the one or more components are disposed;

prepreg between the first and second core layers;

a ground plane integrally defined by an inner electrically-conductive layer of the printed circuit board assembly, wherein the ground plane is between the first core layer defining the upper surface along which the patch antenna element is disposed and the second core layer defining the lower surface along which the one or more components are disposed; and one or more internal signal layers between the ground plane and the second core layer.

8. The printed circuit board assembly of claim 1, further comprising electrically-conductive printed traces and electrically-conductive vias for electrically connecting the patch antenna element to the one or more components.

9. An antenna assembly comprising a base, a cover coupled to the base such that an interior is defined between the cover and the base, and the printed circuit board assembly of claim 1 within the interior.

10. An antenna assembly consisting essentially of:

a multilayer printed circuit board assembly having a top layer and a bottom layer;

a patch antenna element integrally defined by the top layer of the printed circuit board assembly, wherein the patch antenna element is generally rectangular including a pair of truncated opposite corners;

the bottom layer including one or more components along a surface of the printed circuit board assembly;

wherein the multilayer printed circuit board assembly includes:

a first core layer;

a second core layer defining the surface along which the one or more components are disposed;

prepreg between the first and second core layers; and an inner electrically-conductive layer between the first and second core layers that integrally defines a ground plane for the patch antenna element.

11. The antenna assembly of claim 10, wherein the patch antenna element is configured to be operable with one or more satellite navigation frequency bands or satellite digital audio radio services.

12. The antenna assembly of claim 10, wherein the one or more components comprise a low noise amplifier surface mounted to the surface of the multilayer printed circuit board assembly.

13. The antenna assembly of claim 10, wherein the one or more components comprise a low noise amplifier, a microcontroller, a gyroscope, a receiver, and a controller area network transceiver.

14. The antenna assembly of claim 10, wherein the top layer comprises electrically-conductive material etched to integrally define the patch antenna element.

15. An antenna assembly consisting essentially of:

a multilayer printed circuit board assembly having a top layer and a bottom layer;

a patch antenna element integrally defined by the top layer of the printed circuit board assembly, wherein the patch antenna element is generally rectangular including a pair of truncated opposite corners;

the bottom layer including one or more components along a surface of the printed circuit board assembly;

wherein the multilayer printed circuit board assembly includes:

a first core layer;

a second core layer defining the surface along which the one or more components are disposed;

prepreg between the first and second core layers;

an inner electrically-conductive layer between the first and second core layers that integrally defines a ground plane for the patch antenna element; and one or more internal signal layers within the prepreg.

16. An antenna assembly consisting essentially of:

a multilayer printed circuit board assembly having a top layer and a bottom layer;

a patch antenna element integrally defined by the top layer of the printed circuit board assembly, wherein the patch antenna element is generally rectangular including a pair of truncated opposite corners;

the bottom layer including one or more components along a surface of the printed circuit board assembly;

wherein the multilayer printed circuit board assembly includes:

a first core layer;

a second core layer defining the surface along which the one or more components are disposed;

prepreg between the first and second core layers;

an inner electrically-conductive layer between the first and second core layers that integrally defines a ground plane for the patch antenna; and one or more internal signal layers between the ground plane and the second core layer.

17. The antenna assembly of claim 10, further comprising electrically-conductive printed traces and electrically-conductive vias for electrically connecting the patch antenna element to the one or more components.

18. The antenna assembly of claim 10, further comprising a base and a cover coupled to the base such that an interior is defined between the cover and the base, wherein the multilayer printed circuit board assembly is within the interior.

19. The antenna assembly of claim 16, wherein:

the one or more components comprise a low noise amplifier surface mounted to the surface of the multilayer printed circuit board assembly; and the top layer comprises electrically-conductive material etched to integrally define the patch antenna element.

20. An antenna assembly consisting essentially of:

a multilayer printed circuit board assembly having a top layer and a bottom layer;

a patch antenna element integrally defined by the top layer of the printed circuit board assembly, wherein the patch antenna element is generally rectangular including a pair of truncated opposite corners;

the bottom layer including one or more components along a surface of the printed circuit board assembly;

wherein the multilayer printed circuit board assembly includes:

a first core layer;

a second core layer defining the surface along which the one or more components are disposed;

prepreg between the first and second core layers;

a ground plane for the patch antenna element within the prepreg and integrally defined by an inner electrically-conductive layer between the first and second core layers; and one or more internal signal layers between the ground plane and the second core layer.

* * * * *